US011830468B2

(12) United States Patent
Henderson et al.

(10) Patent No.: US 11,830,468 B2
(45) Date of Patent: Nov. 28, 2023

(54) ACOUSTIC SYSTEM AND METHOD

(71) Applicant: Auralex Acoustics, Indianapolis, IN (US)

(72) Inventors: Mark Henderson, Indianapolis, IN (US); Benjamin A. Carlisle, Indianapolis, IN (US); Mark A. Kauffman, Indianapolis, IN (US); Eric T. Smith, Indianapolis, IN (US)

(73) Assignee: Auralex Acoustics Inc., Indianapolis, IN (US)

( * ) Notice: Subject to any disclaimer, the term of this patent is extended or adjusted under 35 U.S.C. 154(b) by 0 days.

(21) Appl. No.: 17/580,179

(22) Filed: Jan. 20, 2022

(65) Prior Publication Data

US 2022/0148552 A1 May 12, 2022

Related U.S. Application Data

(63) Continuation of application No. 16/153,440, filed on Oct. 5, 2018, now Pat. No. 11,257,474.

(60) Provisional application No. 62/570,208, filed on Oct. 10, 2017.

(51) Int. Cl.

| | |
|---|---|
| ***G10K 11/168*** | (2006.01) |
| ***E04B 1/84*** | (2006.01) |
| ***E04B 1/86*** | (2006.01) |

(52) U.S. Cl.

CPC ..... *G10K 11/168* (2013.01); *E04B 1/84* (2013.01); *E04B 1/86* (2013.01); *E04B 2001/8414* (2013.01); *E04B 2001/8471* (2013.01); *E04B 2001/8476* (2013.01)

(58) Field of Classification Search

CPC . G10K 11/168; E04B 2001/8476; E04B 1/84; E04B 1/86; E04B 2001/8471; E04B 2001/8414

USPC ..... 181/290

See application file for complete search history.

(56) References Cited

U.S. PATENT DOCUMENTS

| | | | | |
|---|---|---|---|---|
| 2,935,151 | A | 5/1960 | Watters | |
| 3,021,915 | A | 2/1962 | Kemp | |
| 3,111,187 | A | 11/1963 | Barlow | |
| 3,253,675 | A | 5/1966 | Baruch | |
| 4,296,280 | A | 10/1981 | Richie | |
| 5,113,968 | A | 5/1992 | Lemmon | |
| 7,721,847 | B2 * | 5/2010 | Coury | E04B 9/045 181/293 |
| 7,861,825 | B2 | 1/2011 | Stewart, Jr. | |
| 9,702,143 | B2 | 7/2017 | Perez | |
| 10,096,310 | B2 | 10/2018 | Carlisle et al. | |
| 11,257,474 | B2 * | 2/2022 | Henderson | E04B 1/84 |
| 2003/0048918 | A1 | 3/2003 | Dillon et al. | |
| 2005/0259841 | A1 | 11/2005 | Caron et al. | |
| 2008/0202844 | A1 | 8/2008 | Leclear et al. | |
| 2010/0282536 | A1 | 11/2010 | Carps | |
| 2012/0285767 | A1 * | 11/2012 | Meyer | E04B 1/8209 181/290 |

(Continued)

*Primary Examiner* — Forrest M Phillips

(74) *Attorney, Agent, or Firm* — Thomas P Heed; Heed Law Group

(57) ABSTRACT

An acoustic system is disclosed. The acoustic system includes a number of acoustic panel sections having a variety of acoustic properties. Each acoustic panel section is configured to be mounted on an interior surface of a building and cooperates with the other acoustic panel sections to define a pattern on the interior surface of the building.

18 Claims, 4 Drawing Sheets

(56) References Cited

U.S. PATENT DOCUMENTS

2017/0110104 A1 4/2017 Carliske et al.

* cited by examiner

ACOUSTIC SYSTEM AND METHOD

CROSS-REFERENCE TO RELATED APPLICATIONS

This application is a continuation of U.S. patent application Ser. No. 16/153,440, filed Oct. 5, 2018, which claims priority to U.S. Provisional Patent Appl. No. 62/570,208, filed Oct. 10, 2017. The entire disclosures of the foregoing applications are incorporated herein by reference.

TECHNICAL FIELD

The present disclosure relates generally to an acoustic system configured to absorb sound energy, more particularly, to an acoustic system that includes an acoustic panel and a cover.

BACKGROUND

The purpose of an acoustic panel is to absorb or diffuse sound energy that enters the acoustic panel. In general, acoustic panels are used to control sound and/or reduce noise in a variety of different spaces. For example, a movie theater may include acoustic panels to reduce unwanted sound energy reflected by surfaces in the movie theater.

SUMMARY

An acoustic system is disclosed. The system may be positioned in a room of a personal home or other building. The system includes a plurality of individual sections configured to be mounted to a wall. The system may include a sound absorptive section, a sound diffusive section, a sound producing section, or a number of empty or void sections having no significant acoustic properties. The sections are configured to cooperate to define a pattern on the interior surface.

According to an aspect of the disclosure, an acoustic system comprises a first section including a sound absorptive substrate, and a first polyester shell positioned over the sound absorptive substrate. The first polyester shell is configured to be mounted on an interior surface of a building such that at least some sound waves pass through the first polyester shell. The acoustic system also comprises a second section including a second polyester shell that is configured to be mounted on the interior surface of the building with the first polyester shell. The first and second polyester shells have outer edges that are resistant to bending. The second section is configured to reflect sound waves, and the first section and the second section are configured to cooperate to define a pattern on the interior surface of the building.

In some embodiments, the first polyester shell has a first static value of airflow resistance, and the second polyester shell has a second static value of airflow resistance that may be greater than the first static value. Additionally, in some embodiments, the second static value may be greater than about 5,000 rayls. In some embodiments, the first static value may be less than or equal to 500 rayls.

The acoustic system may further comprise a third section including a sound generating device and a third polyester shell positioned over the sound generating device. The third polyester shell may be configured to be mounted on the interior surface of the building and cooperate with the first polyester shell and the second polyester shell to define the pattern on the interior surface. The third polyester shell may be configured to permit sound waves generated by the sound generating device to pass through to a space beyond the third section.

In some embodiments, each polyester shell may comprise non-woven polyester fibers. Additionally, in some embodiments, each polyester shell may include a front surface having a visible geometric pattern. In some embodiments, the visible geometric pattern may include an engraving. The visible geometric pattern may include an embossed pattern.

In some embodiments, each polyester shell may include a front surface having an aesthetic pattern.

In some embodiments, the second polyester shell may include a cavity that defines an air pocket. In some embodiments, the second section may include a substrate configured to be positioned in a cavity defined in the second polyester shell.

In some embodiments, the sound absorptive substrate may include polyester assembled to achieve a desired absorption coefficient. In some embodiments, the sound absorptive substrate may include mineral fibers, fiberglass, mineral wool, and/or cotton assembled to achieve a desired absorption coefficient.

According to another aspect, an acoustic system comprises a first section configured to be mounted on an interior surface of a building and a second section configured to be coupled to the first section and mounted on the interior surface of the building. The first section includes a sound absorptive substrate, and a first polyester shell positioned over the sound absorptive substrate. The second section includes a second polyester shell, and the second section is one of a reflective section that is configured to reflect sound waves or an acoustically transparent section that is configured to permit the passage of sound waves through the second section. The first section and the second section are configured to cooperate to define a pattern on the interior surface of the building.

In some embodiments, the second section includes a sound reflective substrate positioned in the second polyester shell.

In some embodiments, the second polyester shell may have a static value of airflow resistance of greater than about 5,000 rayls. In some embodiments, the second polyester shell may have a static value of airflow resistance of less than 500 rayls.

Additionally, in some embodiments, the first polyester shell may have a static value of airflow resistance of between 500 and 600 rayls.

In some embodiments, the second section may further include a sound generating device positioned in the second polyester shell. Additionally, in some embodiments, the second polyester shell positioned over the sound generating device may have a static value of airflow resistance of less than 500 rayls.

According to another aspect, a method of controlling sound in a room is disclosed. The method includes selecting a first section including a sound absorptive substrate, and a first polyester shell positioned over the sound absorptive substrate, mounting the first section on an interior surface of the room, selecting a second section including a second polyester shell that is configured to reflect sound waves, and mounting the second section on the interior surface of the room adjacent the first section such that the first section and the second section cooperate to define a pattern on the interior surface of the building.

In some embodiments, the method may include selecting a third section including a sound generating device, and mounting the third section on the interior surface of the room adjacent the first section and the second section such that the sections cooperate to define the pattern on the interior surface of the building.

BRIEF DESCRIPTION OF THE DRAWINGS

The detailed description particularly refers to the following figure, in which:

FIG. 5 is a simplified cross-sectional view of another embodiment of an acoustic panel section of the system of FIG. 1 taken along the line 4-4 in. FIG. 1.

DETAILED DESCRIPTION OF THE DRAWINGS

Figure 1:
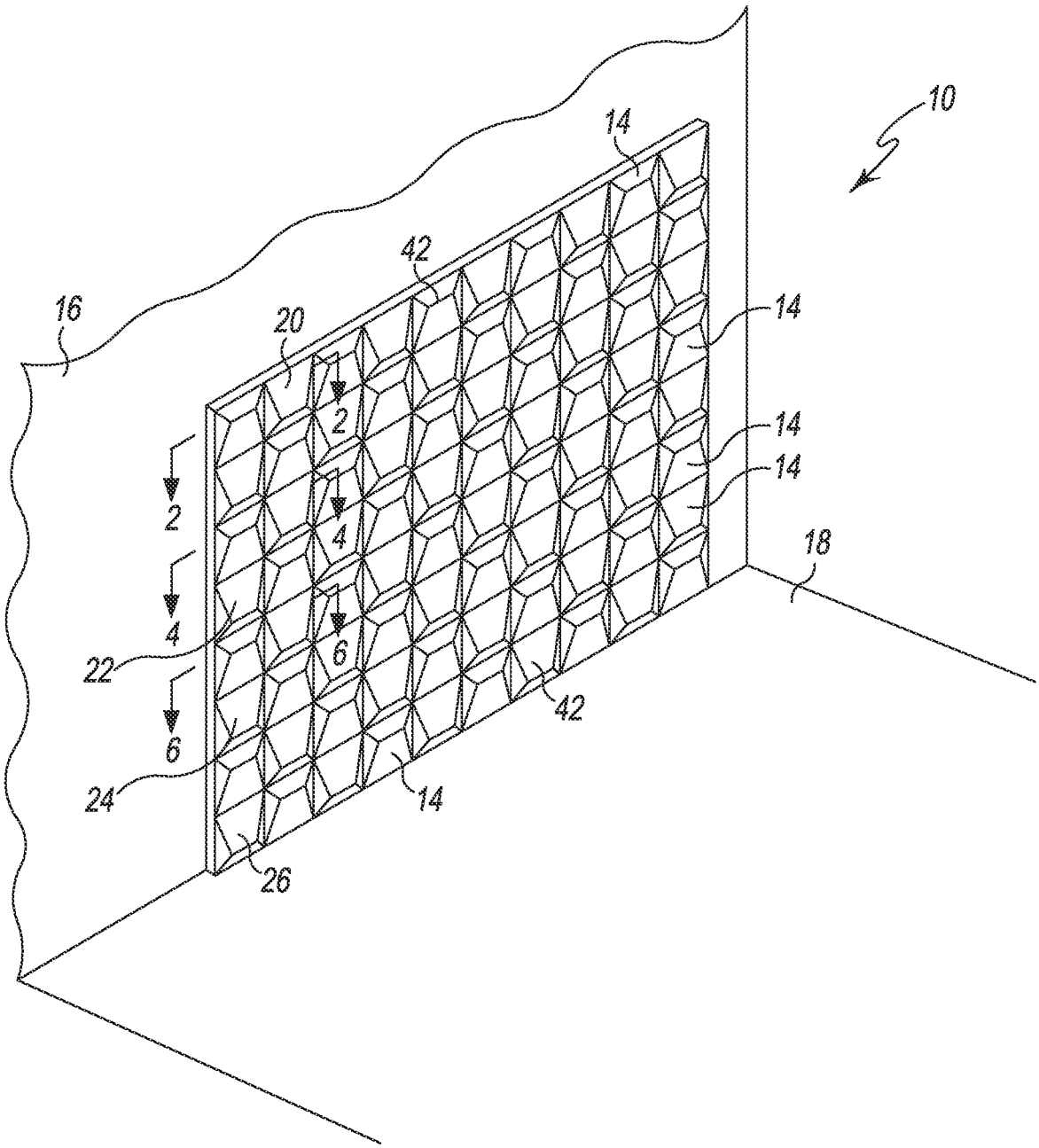
FIG. 1 is a perspective view of an acoustic system.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, one embodiment of an acoustic system 10 is disclosed. The system 10 is positioned in a room 12 of a personal home or other building. The system 10 includes a plurality of individual sections 14 mounted to an interior wall surface 16. The sections 14 are positioned adjacent to one another to define a pattern on the wall 16 that extends upwardly from the floor 18 of the room 12. As described in greater detail below, the system 10 includes a sound absorptive section 20 (see FIGS. 2 and 3), a sound diffusive section 22 (see FIGS. 4 and 5), a sound generating section 24 (see FIG. 6), or a number of empty or void sections 26.

Figure 2:
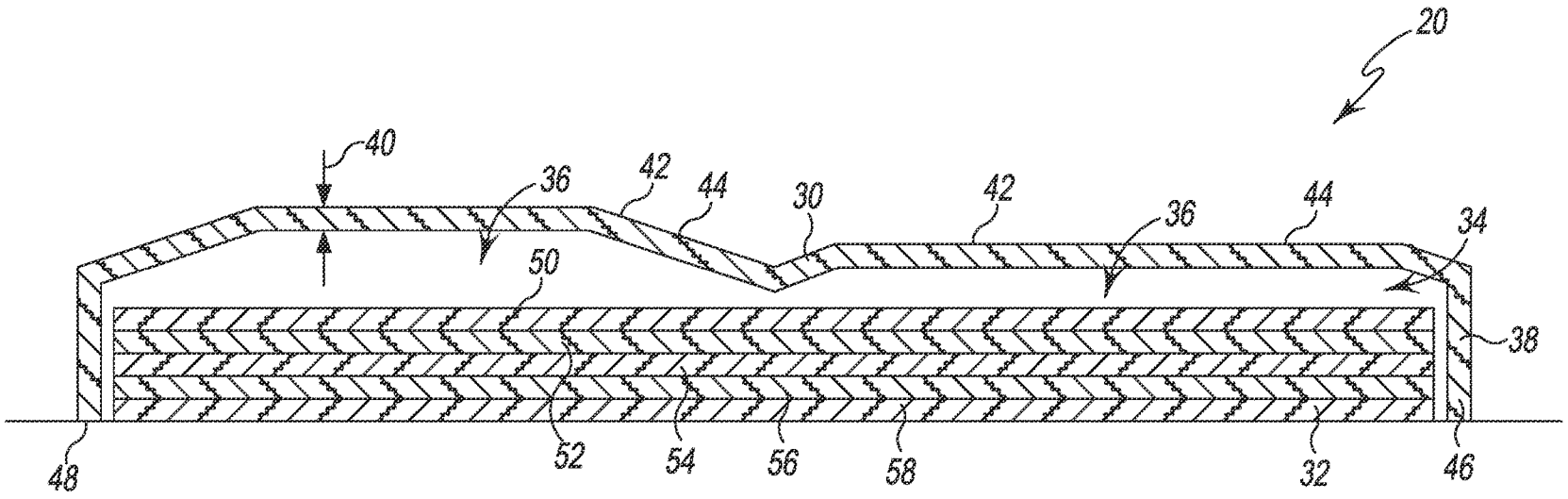
FIG. 2 is a simplified cross-sectional view of an acoustic panel section of the system of FIG. 1 taken along the line 2-2 in FIG. 1.

Referring now to FIG. 2, a sound absorptive section 20 of the system 10 includes a facing or cover 30 and a web or substrate 32 positioned in a cavity 34 of the cover 30. In illustrative embodiment, the cavity 34 includes four compartments 36, and a substrate is positioned in each compartment. It should be appreciated that the substrate may be a single piece that extends into each compartment or multiple pieces with each piece positioned in a different compartment 36. In the illustrative embodiment, all of the compartments 36 are interconnected, and the substrate 32 extends into each compartment 36.

The cover 30 includes a shell 38 that has stiff outer edges that are rigid and resist bending. In the illustrative embodiment, the shell 38 includes rigid corners that are resistant to bending. The shell 38 is a single integral, monolithic component formed from a polyester material. In the illustrative embodiment, the polyester material includes non-woven polyester fibers that have been molded in the shape shown in FIG. 2. The shell 38 has a thickness 40 of 3.0 millimeters (mm). It should be appreciated that in other embodiments the thickness may be greater than or less than three millimeters. The non-woven polyester fibers include 70% PET fiber with 30% low melt, bicomponent or other binding fiber.

The cover 30 is made of a polyester material in which 45% of the polyester material is low-melt polyester. The thickness of the cover 30 may be as thin as 1.5 mm or may be as thick as 6.4 mm. The cover 30 may include as little as 30% low-melt polyester material or may include as much as 60% low-melt polyester material. In some embodiments, the polyester material may include nonwoven polyester fibers.

In the illustrative embodiment, the cover 30 is configured to be self-supporting such that load/weight of the section 20 is carried by the cover 30 alone, and the substrates 32 does not structurally support the mounting of the section 20 to the wall 16. The section 20 also includes a number of brackets (not shown) configured to receive a screw, peg, or other fastener to secure the section 20 to the wall 16. In other embodiments, the section 20 may include a hook and loop fastener system such as, for example Velcro®, to attach the substrate 72 to the wall 16. In addition, clips may be used to secure the covers together.

The shell 38 of the cover 30 includes a plurality of cover panels 42 that are positioned over the substrates 32. In the section 20, there are illustratively four cover panels 42. Each cover panel 42 has a front surface 44. In the illustrative embodiment, the front surface 44 of each cover panel 42 includes a plurality of angled surface sections that cooperate to define the front face of the section 20. It should be appreciated that in other embodiments the front surface 44 may be curved, include a single flat surface section, and/or take other geometric forms. As shown in FIG. 1, the front faces of the individual sections 14 have identical geometries, but it should be appreciated that in other embodiments the sections 14 may have different geometries to give the system 10 a varied visual appearance. The sections may also be embossed to create a unique visual appearance for one or more of the sections.

In the illustrative embodiment, the cover 30 is configured to be acoustically transparent such that sound energy or waves passes through the cover 30. The static value of the airflow resistance of the cover 30 is illustratively less than 500 rayls, and the cover 30 has an average insertion loss of 3 dB or less.

In other embodiments, the cover 30 may be configured to control sound in a space by either absorbing some or all of the sound waves or by reflecting some or all sound waves. For example, one or more patterns may be embossed of the front surface 44 of the cover 30, and the patterns may be configured to reflect certain frequencies of sound waves. The static value of the airflow resistance of the cover of an absorptive section may be between 500 and 600 rayls. The static value of the airflow resistance of the cover of a reflective section may be greater than about 5,000 rayls.

As shown in FIG. 2, an opening 46 is defined in a rear surface 48 of the shell 38. The opening 46 is connected to each compartment 36 in the shell 38 and is sized to receive the substrate 32. In other embodiments, the shell 38 may include multiple openings, and each opening may be connected to a different compartment 36.

As described above, the sound absorptive section 20 includes a substrate 32 positioned in the cover 30. The substrate 32 may be any substrate or structure that is configured to control sound energy in a space and/or absorb sound energy. The illustrative substrate 32 may embodied as a multi-layer acoustic panel comprising layers 50, 52, 54, 56, 58 made of some type of polyester material, layers made of some type of adhesive material, and an outer layer. An exemplary acoustic substrate is shown and described in U.S. Patent Appl. Pub. No. 2017/0110104.

Figure 3:
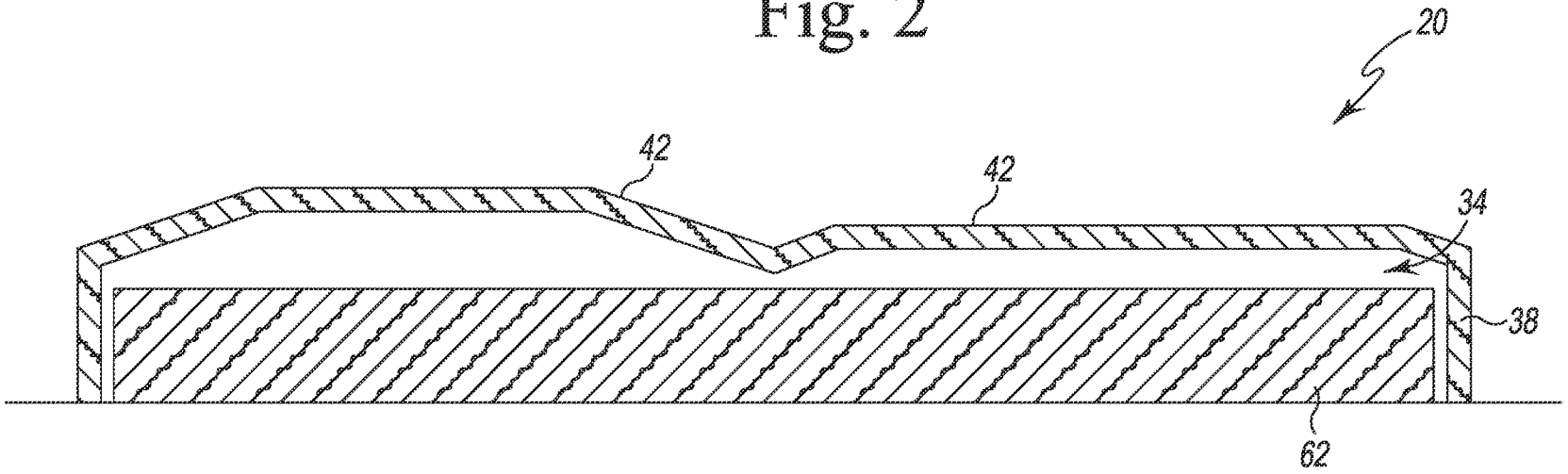
FIG. 3 is a simplified cross-sectional view of another embodiment of an acoustic panel section of the system of FIG. 1 taken along the line 2-2 in FIG. 1.

As shown in FIG. 3, the substrate (identified as substrate 62) may be a single homogeneous layer of polyester material. The substrate 62 has a thickness 64 of about 60 mm, and the static value of the airflow resistance of the substrate 62 is between 500 and 600 rayls. In other embodiments, the static value of the airflow resistance may be adjusted to change the absorptive characteristics of the substrate 62. To do so, the thickness 64, bulk density of the fibers, or the fiber type may be adjusted. In other embodiments, the absorptive material may include mineral fibers. In still other embodiments, the absorptive material may include fiberglass, mineral wool, and/or cotton to achieve a desired absorption.

As described above, the system 10 also includes a sound diffusive section 22 that is positioned on the wall 16 adjacent the sound absorptive section 20. The diffusive section 22 includes a facing or cover 70 and a web or substrate 72 positioned in a cavity 74 of the cover 70. In illustrative embodiment, the cavity 74 includes four compartments 76 that are defined in the cover 70, and a substrate is positioned in each compartment. It should be appreciated that the substrate may be a single piece that extends into each compartment or multiple pieces with each piece positioned in a different compartment 76. In the illustrative embodiment, all of the compartments 76 are interconnected, and the substrate 72 extends into each compartment 76.

The cover 70 includes a shell 78 that is a single integral, monolithic component that is formed from a polyester material. In the illustrative embodiment, the polyester material includes non-woven polyester fibers that have been molded in the shape shown in FIG. 4. The non-woven polyester fibers include 70% PET fiber with 30% low melt, bicomponent, or other binding fiber.

In the illustrative embodiment, the cover 70 is configured to be self-supporting such that load/weight of the section 22 is carried by the cover 70 alone, and the substrate 72 does not structurally support the mounting of the section 20 to the wall 16. The section 22 also includes a number of brackets (not shown) configured to receive a screw, peg, or other fastener to secure the section 20 to the wall 16. In other embodiments, the section 22 may include a hook and loop fastener system such as, for example Velcro®, to attach the substrate 72 to the wall 16. In addition, clips may be used to secure the covers together.

The shell 78 of the cover 70 includes a plurality of cover panels 80 that are positioned over the substrates 72 in the section 22, there are illustratively four cover panels 80. Each cover panel 80 has a front surface 84. As described above, the front faces of the individual sections 14 (including the sections 20, 22, 24, and 26) have identical geometries, but it should be appreciated that in other embodiments the sections 14 may have different geometries to give the system 10 a varied visual appearance.

The cover 70 is configured to reflect sound energy or waves generated in the room 12. In that way, the section 22 is configured to eliminate echoes and other acoustic anomalies from the room 12 by dispersing sound more evenly through the room 12. The static value of the airflow resistance of the cover 70 is greater than about 5,000 rayls. It should be appreciated that in other embodiments the cover of the section 22 may be configured to be acoustically transparent such that sound energy or waves passes through the cover. In such embodiments, a diffuser panel such as, for example, a T'Fusor™ 3D Sound Diffusor, which is commercially available from Auralex acoustics, may be positioned in one or more of the cover compartments.

Figure 4:
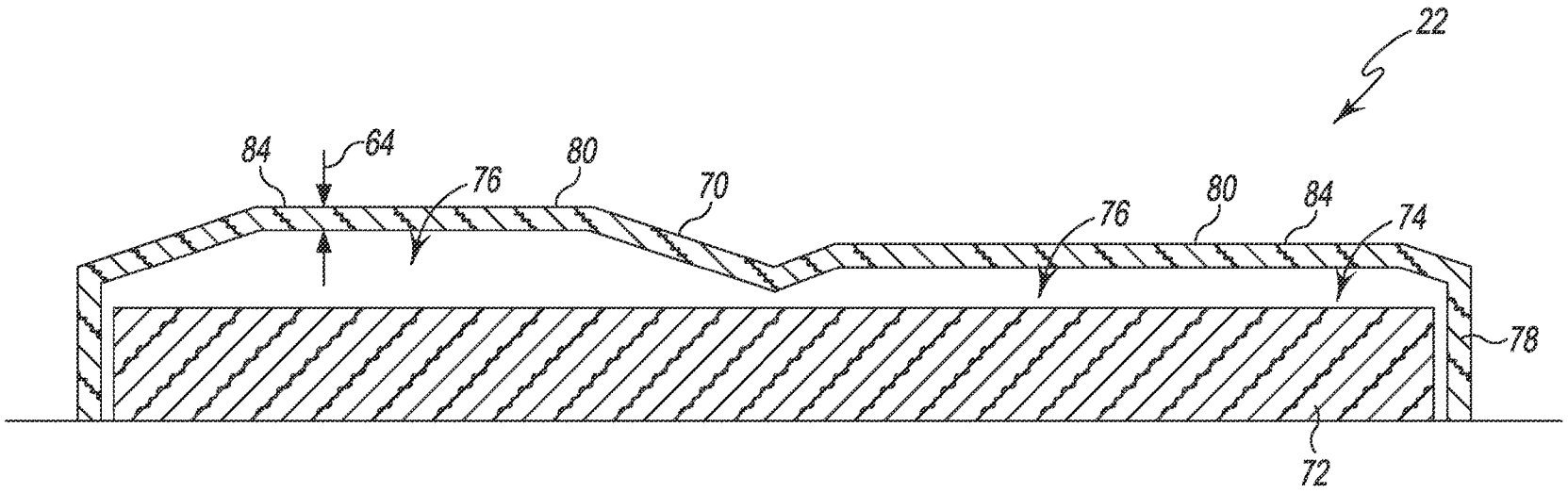
FIG. 4 is a simplified cross-sectional view of an acoustic panel section of the system of FIG. 1 taken along the line 4-4 in FIG. 1.

As shown in FIG. 4, the cover 70 is positioned over a substrate 72. In the illustrative embodiment, the substrate 72 is configured to absorb low frequency sound waves and reflect middle and high frequency sound waves. Low midrange frequencies may be between 160 Hz and 315 Hz. Middle midrange frequencies may be in a range of 315 Hz and 2000 Hz. High midrange frequencies may be in a range of 2000 Hz and 5000 Hz The substrate 72 is formed from 70% PET fiber with 30% low melt, bicomponent, or other binding fiber. In other embodiments, the substrate 72 may include mineral fibers. In still other embodiments, the substrate 72 may include fiberglass, mineral wool, and/or cotton to achieve a desired diffusion.

Figure 5:
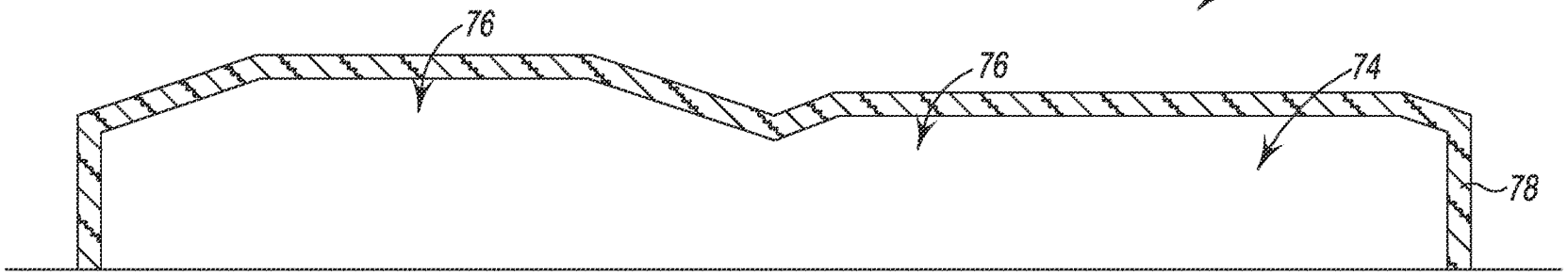

As shown in FIG. 5, the cavity 74 of the section 22 may defined an air pocket that is empty or devoid of any substrates. In such embodiments, the section 22 is configured to utilize the acoustic properties of air to provide the desired acoustic properties.

Figure 6:
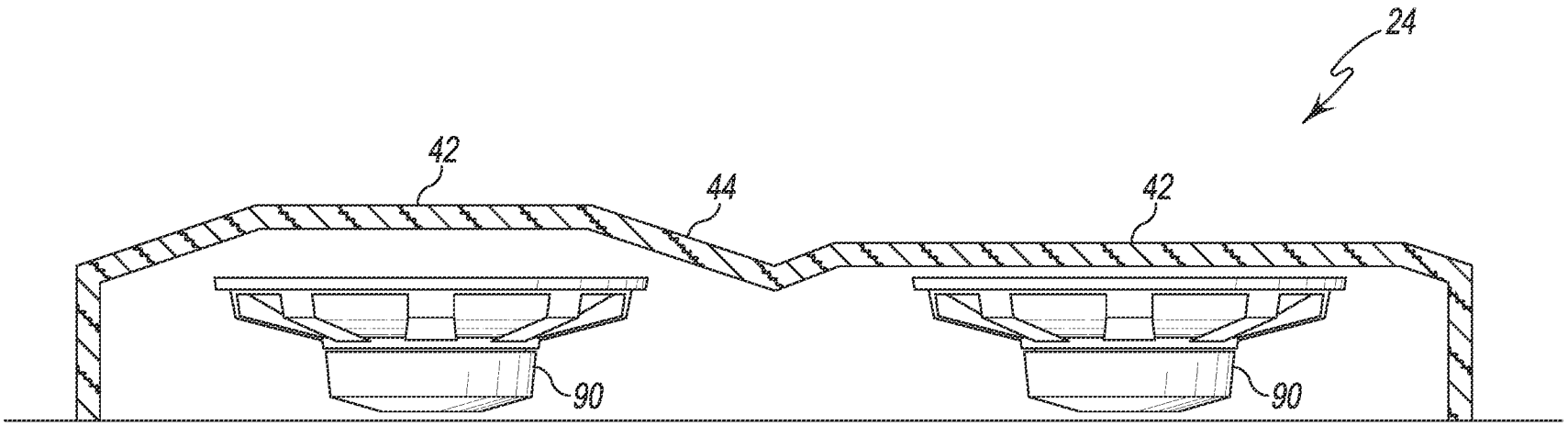
FIG. 6 is a simplified cross-sectional view of an acoustic panel section of the system of FIG. 1 taken along the line 6-6.

As described above, the system 10 also includes a sound generating section 24 that is positioned on the wall 16 adjacent the other sections 20, 22. Like the other section 20, the sound generating section 24 includes a cover 30 that is configured to be acoustically transparent such that sound energy or waves passes through the cover 30. As shown in FIG. 6, the sound generating section 24 also includes a pair of speakers 90 that are positioned in the compartments 36 of the cover 30. The speaker 90 is operable to generate sound that passes through the acoustically transparent cover 30 and into the room 12. In such acoustically transparent embodiments, the cover may have a static value of the airflow resistance of less than 500 rayls.

It should be appreciated that the system 10 includes more than one absorptive sections 20, more than one sound diffusive sections 22, and more than one sound generating sections 24 in the illustrative embodiment. Although system 10 illustratively has multiple sound absorptive sections 20, a multiple sound diffusive sections 22, and multiple sound generating sections 24, it should be appreciated that in other embodiments the acoustic system may include any combination of absorptive, diffusive, and generating sections depending on the features of the room and the desired acoustic characteristics. For example, in other embodiments, the system may include only absorptive sections, only diffusive sections, or only diffusive sections and generating sections.

It should also be appreciated that the covers 30, 70 of the sections 14 are configured to provide aesthetic features of the acoustic system 10 by concealing any substrates 32, 62 and speakers 90 from visual observation and providing aesthetic finishes, such as shapes, colors and/or designs, to the acoustic system 10. The covers 30, 70 may be molded into a variety of aesthetically pleasing or ornamental shapes using heat and pressure. The covers 30, 70 may also be embossed with a pattern to display shapes on the front surfaces 44 or to add texture to the covers 30, 70. The covers 30, 70 may also be dyed or printed with certain colors. For example, the covers 30, 70 may be dyed to be a certain color, such as white. In another example, one or more images may be printed on the front surfaces 44 of the covers 30, 70.

There exist a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

We claim:

1. An acoustic system, comprising:

a plurality of wall-mounted sections of a first type, each including: (i) a sound absorptive substrate, and (ii) a polyester shell of a first type positioned over the sound absorptive substrate, the polyester shell of a first type being configured to be mounted on an interior surface of a building such that at least some sound waves pass through the polyester shell of a first type, and a plurality of wall-mounted sections of a second type, each including a polyester shell of a second type that is configured to be mounted on the interior surface of the building with the first polyester shell, wherein the polyester shells of a first type each have an outer edge resistant to bending, and wherein the polyester shells of a second type each have an outer edge resistant to bending, and wherein the plurality of wall-mounted sections of a second type are configured to reflect sound waves and the plurality of wall-mounted sections of a first type and the plurality of wall-mounted sections of a second type are configured to be peripherally adjacent so as to define a pattern on the interior surface of the building.

2. The acoustic system of claim 1, wherein: the plurality of wall-mounted polyester shells of a first type each have a first static value of airflow resistance, and the plurality of wall-mounted polyester shells of a second type each have a second static value of airflow resistance that is greater than the first static value.

3. The acoustic system of claim 2, wherein the second static value is greater than about 5,000 rayls.

4. The acoustic system of claim 3, wherein the first static value is between 500 and 600 rayls.

5. The acoustic system of claim 1, further comprising:

a plurality of wall-mounted sections of a third type, each including (i) a sound generating device, and (ii) a polyester shell of a third type positioned over the sound generating device, the polyester shells of a third type being configured to be mounted on the interior surface of the building and cooperate with the plurality of wall-mounted polyester shells of a first type and the plurality of wall-mounted polyester shells of a second type to define the pattern on the interior surface, wherein each of the plurality of wall-mounted polyester shells of a third type are configured to permit sound waves generated by their respective sound generating device to pass through to a space beyond the respective section of a third type.

6. The acoustic system of claim 1, wherein each polyester shell comprises non-woven polyester fibers.

7. The acoustic system of claim 1, wherein each polyester shell includes a front surface having a visible geometric pattern.

8. The acoustic system of claim 7, wherein the visible geometric pattern includes an embossed pattern.

9. The acoustic system of claim 1, wherein each polyester shell includes a front surface having an aesthetic pattern.

10. The acoustic system of claim 1, wherein the each of the plurality of wall-mounted sections of a second type each includes a substrate configured to be positioned in a cavity defined in their respective polyester shell of a second type.

11. The acoustic system of claim 1, wherein each of the plurality of wall-mounted polyester shells of a second type includes a cavity that defines an air pocket.

12. An acoustic system, comprising:

a plurality of wall-mounted sections of a first type, each being configured to be mounted on an interior surface of a building, and each of the plurality of wall-mounted sections of a first type including: (i) a sound absorptive substrate, and (ii) a polyester shell of a first type positioned over the sound absorptive substrate, and a plurality of wall-mounted sections of a second type, each being configured to be acoustically coupled to one of the plurality of wall-mounted sections of a first type and mounted on the interior surface of the building, each of the plurality of wall-mounted section of a second type including a polyester shell of a second type, wherein of the plurality of wall-mounted sections of a second type are one of (i) a reflective section that is configured to reflect sound waves or (ii) an acoustically transparent section that is configured to permit the passage of sound waves, and wherein the plurality of wall-mounted sections of a first type and the plurality of wall-mounted sections of a second type are configured to be peripherally adjacent so as to define a pattern on the interior surface of the building.

13. The acoustic system of claim 12, wherein each of the sections of a second type that are reflective sections include a sound reflective substrate positioned in the polyester shell of a second type.

14. The acoustic system of claim 12, wherein:

the polyester shell of a first type has a first static value of airflow resistance, and the polyester shell of a second type has a second static value of airflow resistance that is greater than the first static value.

15. The acoustic system of claim 12, wherein each of the plurality of wall-mounted the polyester shells of a second type have a static value of airflow resistance of greater than 5,000 rayls.

16. The acoustic system of claim 12, wherein each of the plurality of wall-mounted the polyester shells of a second type have a static value of airflow resistance of less than 500 rayls.

17. The acoustic system of claim 12, wherein each of the plurality of wall-mounted the polyester shells of a first type have a static value of airflow resistance of between 500 and 600 rayls.

18. The acoustic system of claim 12, wherein each polyester shell comprises non-woven polyester fibers.

* * * * *